United States Patent [19]

Kimura

[11] Patent Number: 4,628,408

[45] Date of Patent: Dec. 9, 1986

[54] INPUT DEVICE

[75] Inventor: Kiyoshi Kimura, Aza-Fujigasaki, Japan

[73] Assignee: Alps Electric Co., Ltd., Japan

[21] Appl. No.: 771,889

[22] Filed: Sep. 3, 1985

[30] Foreign Application Priority Data

Sep. 3, 1984 [JP] Japan ..... 59-132668[U]

[51] Int. Cl.[4] ..... H01H 9/08

[52] U.S. Cl. ..... 361/395; 340/365 VL; 340/815.2; 178/18; 361/398; 200/159 B

[58] Field of Search ..... 361/331, 380, 392, 395, 361/398, 417, 419, 420; 200/85 R, 86 R, 159 B, 5 A; 340/365 A, 365 C, 365 VL, 815.2, 712, 718, 719; 178/18, 19, 20

[56] References Cited

U.S. PATENT DOCUMENTS 4,427,861 1/1984 Stillie ..... 340/365 VL 4,529,959 7/1985 Ito ..... 178/18

*Primary Examiner*—G. P. Tolin

*Attorney, Agent, or Firm*—Guy W. Shoup

[57] ABSTRACT

An input device for use in a display unit such as a CRT includes a lower electrode of an electrically conductive material and having a plurality of apertures therein, a resilient insulating base superimposed on the lower electrode and having a plurality of integral dot spacers projecting through the apertures, the resilient insulating base having recessed spaces, an upper flexible insulating sheet disposed in confronting relation to the insulating base with the dot spacers interposed therebetween, the upper flexible insulating sheet supporting an upper electrode on one surface thereof, a printed-circuit board disposed below the insulating base, and a plurality of diodes mounted on the printed-circuit board and accommodated in the spaces, the printed-circuit board having an electrically conductive pattern disposed on a lower surface thereof and connected to the diodes. The upper insulating sheet has extensions extending around sides of the insulating base and the printed-circuit board onto the lower surface of the latter, the upper electrode having terminal leads extending over the extensions and connected by a heat seal to the electrically conductive pattern.

3 Claims, 2 Drawing Figures

INPUT DEVICE

BACKGROUND OF THE INVENTION

The present invention relates to an input device for use with a display unit such for example as a CRT (cathode-ray tube) used as a computer terminal, and more particularly to a stylus-type input device for detecting a position in which a panel surface is depressed by a stylus.

There is known an input device composed of an upper electrode disposed on a surface of an insulating sheet and a lower electrode disposed on a surface of an insulating base, the upper and lower electrodes being disposed in confronting relation with insulating projections interposed therebetween. In such an input device, the upper electrode has a plurality of terminal leads extending in X- and Y-axis directions and connected to diodes for determining the directions of currents flowing through the terminal leads. When a certain voltage is applied between mutually confronting terminal leads and a stylus is pressed against the insulating sheet at a certain position, the upper electrode is depressed downwardly into contact with the lower electrode. The potential in the X- and Y-axis directions at the depressed position is then detected such that the depressed position can be recognized as X and Y coordinates. The diodes have conventionally been mounted on a block board different from a printed-circuit board disposed in confronting relation to the lower surface of the insulating base, the diodes being connected by connectors or the like to the printed-circuit board. Therefore, the wiring resistance between the terminal leads and the diodes is increased, and the number of connectors used is also increased, resulting in a greater cost.

SUMMARY OF THE INVENTION

It is an object of the present invention to provide an input device in which the wiring resistance between terminal leads of an upper electrode and diodes connected thereto is reduced as much as possible and connectors or the like are dispensed with to achieve a cost reduction.

To achieve the above object, diodes are mounted on a printed-circuit board and accommodated in spaces defined in an insulating base, and an insulating sheet has extensions extending around sides of the insulating base and the printed-circuit board onto a lower surface of the printed-circuit board. On the lower surface of the printed-circuit board, terminal leads of an upper electrode which extend over the extensions are connected by heat-sealing to an electrically conductive pattern disposed on the lower surface of the printed-circuit board for connection to the diodes.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
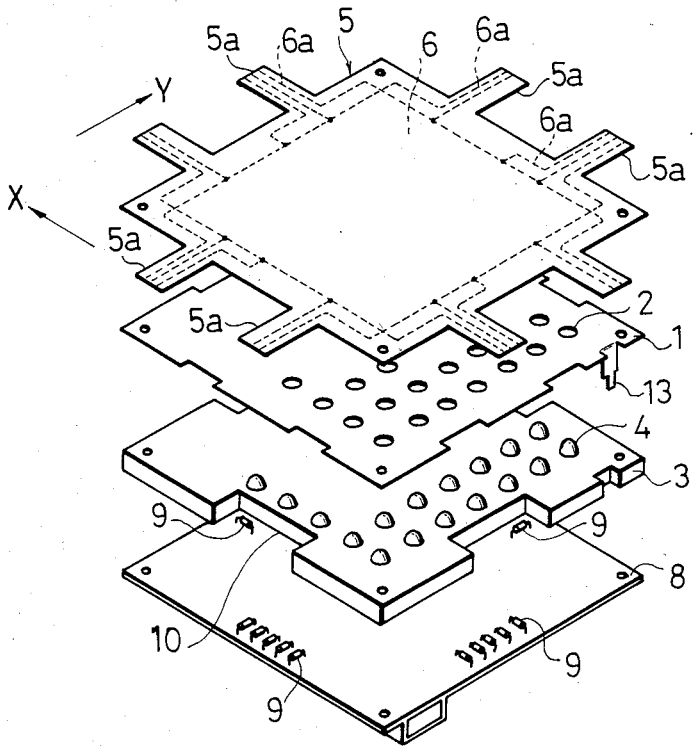
FIG. 1 is an exploded perspective view of an input device according to the present invention.
Figure 2:
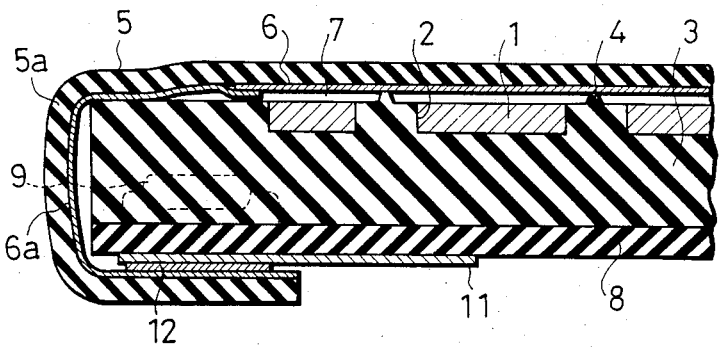
FIG. 2 is an enlarged fragmentary cross-sectional view of the input device.

As shown in FIGS. 1 and 2, a thin sheet 1 of corrosion-resistant metal such as stainless steel, having a thickness of 1 mm for example, has a plurality of small apertures 2 defined therethrough at a pitch of 1 mm, for example, and each having a diameter of 0.3 mm, for example. The apertures 2 can be formed by a chemical process such as etching or a mechanical process such as pressing. An insulating base 3 is formed of a resilient insulating material such as elastomer, by outsert molding, on the lower surface of the thin metal sheet 1, as shown in FIG. 2, the insulating base 3 having a plurality of projections 4 extending through the apertures 2 beyond the upper surface of the thin metal sheet 1. The projections 4 serve as dot spacers, and the portion of the thin metal sheet 1 which is free from the dot spacers 4 serves as a lower electrode. An upper flexible insulating sheet 5 is disposed over the insulating base 3 with the dot spacers 4 interposed therebetween. The insulating sheet 5 supports on its lower surface an upper electrode 6 composed of a resistive layer and facing the lower electrode 1 with an air gap 7 therebetween which is defined by the dot spacers 4.

The upper insulating sheet 5 has extensions **5*a* extending in X- and Y-axis directions supporting on their lower surfaces terminal leads 6*a* extending from the ends of the upper electrode 6 in the X- and Y-axis directions. A printed-circuit board 8 is disposed on the lower surface of the insulating base 3 and supports thereon a pluraltiy of diodes 9 disposed in the X- and Y-axis directions and connected respectively to the terminal leads 6*a*. The diodes 9 are accommodated in recessed spaces 10 defined in the insulating base 3. The thickness of the insulating base 3, i.e., the spaces 10 is selected to be greater than the height of the diodes 9 mounted on the printed-circuit board 8. An electrically conductive pattern 11 for connection to terminals of the diodes 9 is formed on the lower surface of the printed-circuit board 8. The extensions 5*a* of the upper insulating sheet 5 extend around sides of the insulating base 3 and the printed-circuit board 8 onto the lower surface of the latter, as shown in FIG. 2, and the terminal leads 6*a* are connected by a heat seal 12 to the conductive pattern 11. The lower electrode 1 has a terminal 13 for connection to the printed-circuit board 8**.

With the input device thus constructed, a prescribed voltage is applied between the confronting terminal leads **6*a* in the X- and Y-directions by passing currents between the terminal leads 6*a* in the X- and Y-directions through the diodes 9 coupled to the terminal leads 6*a*. When the upper insulating sheet 5 is depressed at a position, the upper electrode 6 is lowered into contact with the lower electrode 1. The potential at the depressed position in the X- and Y-directions is detected by the lower electrode 1, and the detected voltage is applied via the terminal 13 to the printed-circuit board 1**.

The input device of the above embodiment has the following advantages:

(1) The diodes 9 are mounted in the X- and Y-directions on peripheral sides of the printed-circuit board 8 and accommodated in the spaces 10 defined in peripheral sides of the insulating base 3. This arrangement dispenses with connectors and achieves a cost reduction as compared with a conventional construction in which the diodes 9 are mounted on a separate block plate that is connected by connectors to the printed-circuit board 8.

(2) As shown in FIG. 2, the extensions 5*a* of the upper insulating sheet 5 extend around the sides of the printed-circuit board 8 onto the lower surface thereof, with the terminal leads 6*a* connected via the heat seal to the conductive pattern 11 over a short distance which is connected to the diodes 9. Therefore, the wiring resistance is made smaller than would be the conventional arrangement.

(3) Since the dot spacers 4 are formed of the resilient insulating material, the dot spacers 4 will flex together with the upper insulating sheet in the same direction when a pattern is drawn on the upper insulating sheet 5 with a stylus. Therefore, the dot spacers 4 give a cushioning action against the depression of the stylus, which produces a smooth feel on cotact with the upper insulating sheet 5.

(4) Inasmuch as the dot spacers 4 are resilient, they will flex when depressed and produce no dead zone, with the result that the resolution can be higher than the prior arrangement.

(5) As the dot spacers 4 are integrally formed with the insulating base 3, they will not be peeled off. The resilient dot spacers 4 will flex when depressed by the stylus, and will be subjected to a smaller wear on their tips than the conventional arrangement. When the upper insulating sheet 5 is released of the pressure from the stylus, the upper insulating sheet 5 will be restored to its original shape under its own resiliency and the resiliency of the dot spacers 4. Thus, the force with which the upper insulating sheet 5 will not be reduced as it is repeatedly depressed.

(6) The lower electrode 1 is in the form of a thin metal sheet, and the insulating base 3 and the dot spacers 4 are integrally formed of a resilient insulating material by outsert molding. Accordingly, the number of parts and manufacturing steps can be reduced to lower the cost in manufacturing the switches.

With the present invention, as described above, any connectors which have heretofore been required are dispensed with resulting in a reduced cost, and the terminal leads of the upper electrode are connected to the diodes through a minimum distance so that the wiring resistance can be as small as possible.

Although a certain preferred embodiment has been shown and described, it should be understood that many changes and modifications may be made therein without departing from the scope of the appended claims.

What is claimed is:

1. An input device comprising:

(a) a lower electrode of an electrically conductive material and having a plurality of apertures therein;

(b) a resilient insulating base superimposed on said lower electrode and having a plurality of integral dot spacers projecting through said apertures, said resilient insulating base having recessed spaces;

(c) an upper flexible insulating sheet disposed in confronting relation to said insulating base with said dot spacers interposed therebetween, said upper flexible insulating sheet supporting an upper electrode on one surface thereof;

(d) a printed-circuit board disposed below said insulating base;

(e) a plurality of diodes mounted on said printed-circuit board and accommodated in said spaces, said printed-circuit board having an electrically conductive pattern disposed on a lower surface thereof and connected to said diodes; and (f) said upper insulating sheet having extensions extending around sides of said insulating base and said printed-circuit board onto the lower surface of the latter, said upper electrode having terminal leads extending over said extensions and connected by a heat seal to said electrically conductive pattern.

2. An input device according to claim 1, wherein said recessed spaces 10 are defined in peripheral sides of said insulating base, said diodes being mounted on peripheral sides of said printed-circuit board.

3. An input device according to claim 1, wherein said extensions extend in X- and Y-axis directions of said upper insulating sheet.

* * * * *